US008708834B1

(12) United States Patent
Domangue

(10) Patent No.: US 8,708,834 B1
(45) Date of Patent: Apr. 29, 2014

(54) GOLF POSTURE AND SWING TRAINING HARNESS

(71) Applicant: Elizabeth Domangue, Colorado Springs, CO (US)

(72) Inventor: Elizabeth Domangue, Colorado Springs, CO (US)

( * ) Notice: Subject to any disclaimer, the term of this patent is extended or adjusted under 35 U.S.C. 154(b) by 0 days.

(21) Appl. No.: 13/943,133

(22) Filed: Jul. 16, 2013

(51) Int. Cl.
*A63B 69/36* (2006.01)

(52) U.S. Cl.
USPC ..... 473/215; 473/207

(58) Field of Classification Search
USPC ..... 473/207, 208, 215, 216, 266, 274–277; 602/5, 17–19, 32, 36; 482/10, 51, 109, 482/110
See application file for complete search history.

(56) References Cited

U.S. PATENT DOCUMENTS 1,581,791 A * 4/1926 Davison ..... 2/44
2,469,301 A 5/1949 Johnston
2,611,610 A 5/1950 Hara
3,346,257 A * 10/1967 Whitney ..... 473/215
5,199,940 A * 4/1993 Morris et al. ..... 602/19
5,242,377 A * 9/1993 Boughner et al. ..... 602/17
5,435,563 A * 7/1995 Salvatore ..... 473/215
5,785,603 A 7/1998 Lazier
5,868,691 A * 2/1999 Vishnevsky ..... 602/19
6,517,446 B2 2/2003 Waddell
6,575,844 B1 6/2003 Gray
6,719,640 B1 * 4/2004 Madole ..... 473/215
7,086,958 B2 8/2006 Eigiro
7,134,969 B2 11/2006 Citron et al.
8,088,020 B2 1/2012 Groves
8,277,331 B2 10/2012 Whitt et al.

* cited by examiner

*Primary Examiner* — Nini Legesse
(74) *Attorney, Agent, or Firm* — BL Speer & Associates; Brenda L. Speer

(57) ABSTRACT

The golf posture and swing training harness of the present invention allows for convenience in set up, usage, and portability and may be worn by a user during golf training or playing. The harness comprises a body, two shoulder straps attached to the body, at least a waist strap either fixedly or removably attached to the body, and a shaft; wherein the shaft is removably inserted within a channel that extends the length of the body. When the user wears the harness, the shaft extends above and below the channel and the shaft contacts a back of the user's head, the user's scapular or upper back area, and the user's sacrum or lower back area, and these three points of contact of the shaft with the user's body enable the user to learn and achieve a proper golf posture and swing.

14 Claims, 9 Drawing Sheets

GOLF POSTURE AND SWING TRAINING HARNESS

BACKGROUND OF THE INVENTION

1. Field of the Invention

The present invention relates to a golf posture and swing training harness.

2. Description of Related Art Including Information Disclosed Under 37 CFR 1.97 and 37 CFR 1.98

Proper posture in golf is important not only to execute an accurate swing, but also to prevent injury to a golfer. Various devices are known that may be used to aid a golfer in improving his or her swing.

Golf training devices can provide a golfer with consistent motor feedback to ensure that through all stages of a golf swing the golfer maintains an appropriate posture. An effective training device for golf is appropriate for any golfer who is interested in learning a perfect form for a golf swing, either from an initial introduction to the game of golf; to change a poor, learned habit; or to rehabilitate from an injury.

U.S. Pat. No. 2,469,301 issued 3 May 1949, by Johnston for Golf Practice Device discloses a base on which the user stands and places the bands about his body at the hipline thereof. When so positioned the projection on the head is held in contact with the back of the body in the region of the sacro-iliac. Then as the body is pivoted to either the left or the right, it is compelled to move about the pivot point established by the projection in its rotary motion with the shaft in conformity with the body movement required in establishing and developing accurate habits necessary when making a correct swing.

U.S. Pat. No. 2,611,610 issued 16 May 1950, by Hara for Mechanical Golf Player's Stance Position discloses a telescoping post mounted on a stand having a stance indicating means thereon with hip pads adjustably mounted on the post, with a head engaging element extended from the upper end of the post, and with a shoulder blade bar and straps adjustably mounted on the arm by which the head engaging element is adjustably attached to the upper end of the post.

U.S. Pat. No. 5,785,603 issued 28 Jul. 1998, by Lazier for Golf Swing Teaching Aid discloses a golf swing teaching aid that has been designed to teach a golfer the proper amount of torso and back rotation in executing a back swing for a tee or iron stroke. The teaching aid comprises a harness worn over the golfer's back and an elongate wand that attaches to the harness and extends laterally to the golfer's side. When the golfer stands next to the ball and executes the back swing, the tip of the wand is rotated into a predetermined visual relationship with the ball. Preferably, the tip of the wand is rotated into approximately a plane containing the golf ball and the golfer's eye.

U.S. Pat. No. 6,517,446 issued 11 Feb. 2003, by Waddell for Apparatus and Product for Improving a Golfer's Swing discloses an improved training aid and method for teaching and improving the swing of a golfer. The device includes a rigid upper torso support, a rigid thigh support, and a rigid calf support that are strapped on a selected side of the body of the golfer. A rigid stabilizer is secured between the rigid upper torso and the rigid thigh support. The method includes the use of the training aid strapped on one side of the body of the golfer and to aid the golfer in turning and maintaining balance over a ball during a golf swing, while preventing a reverse C and unwanted movement toward or away from the ball, or the direction it is desired that the ball travel.

U.S. Pat. No. 6,575,844 issued 10 Jun. 2003, by Gray for Golf Stance and Movement Training Device discloses a training device that has a u-shaped base comprised of an adjustable toe board strip, which is used to promote balance on the balls of the feet and keep the training device from tipping over. The adjustable knee brace, attached to one of three vertical masts, is positioned on the side of the body producing the back swing. The knee brace, contacts the side and back of knee, supporting the proper angle of the knee while controlling lateral and vertical movement. An adjustable upper support assembly and telescoping lateral bar positions a golfer in the center of the device. A telescoping horizontal back bar in conjunction with an angled side bar, contacts the lower lumbar of back and hips on the side of the body producing a back swing, effectively controlling lateral and vertical movement. An angled padded vertical bar positioned in the center of the back, promotes the proper spine angle and allows a golfer to stay centered by rotating the upper body around the bar as the axis of the spine and clearing in the follow-through swing.

U.S. Pat. No. 7,086,958 issued 8 Aug. 2006, by Eigiro for Posture Correcting Tool discloses a posture correcting tool that allows a golf player to practice so that the forward inclination angle of the upper-half body when impacting on a ball with a club can be controlled appropriately and extend the ball flight distance. Being a posture correcting tool worn by a player when practicing club swings, it has a wearing unit which can be fixed to the player's waist, a back fitting unit which is rotatably joined with the wearing unit, arranged so that it can fit with the player's back when worn, and can regulate the forward inclination angle of the upper-half body when the player swings a golf club, and an angle indicating unit with which the forward inclination angle can be visually checked.

U.S. Pat. No. 7,134,969 issued 14 Nov. 2006, by Citron et al. for Golf Posture Brace and Garment discloses a device and method encouraging or ensuring proper posture of a golfer during a golf swing. In certain embodiments, the device may be in the form of a brace comprising a strap that fits around the body to resist or prevent excessive bending of the spine, or "hunching over," during the golf swing. The brace may have a single, continuous strap that winds around the body, forming a crossing pattern across the spine and passing over both shoulders, with the ends of the strap meeting in the front of the body. The ends of the strap may be suitably joined, for example by a buckle, to allow adjustment. The brace may be an integral part of a garment, which may have an outer shell and inner lining.

U.S. Pat. No. 8,088,020 issued 3 Jan. 2012, by Groves for Golf Swing Training Apparatus discloses a golf swing training apparatus that includes a base, a supporting member extending from the base and a body restraining member slidably and pivotably coupled to the supporting member. A swivel mechanism detachably interconnects the supporting member to the body restraining member. The body restraining member includes a slide member with an enlarged cylindrical roller at one end. The swivel mechanism allows the cylindrical roller to be positioned to any height and any angular position within a substantially 360° range of motion. A pivotable supporting member may also be provided.

U.S. Pat. No. 8,277,331 issued 2 Oct. 2012, by Whitt et al. for Golf Training Method and Apparatus discloses an apparatus and method for use in training a golf player in the proper stance for swinging in full rotation, as well as for teaching direction putting skills. Specifically, the invention focuses upon training a golf player to assume a correct stance and posture from the point of addressing the ball through the swing and follow-through by employing a positioning item for a golf player's lower posterior, back, and head.

The various known devices that may be used to aid a golfer in improving his or her swing have disadvantages. Some of the known devices must be in contact with or anchored to the ground and, therefore, are not readily portable or usable on a golf course during a golf game. Other known devices are cumbersome when worn by a golfer and are restrictive of a golfer's movement and, therefore, are not practical for use while playing golf, but only while training. Still other known devices require incorporation into an item of a golfer's attire and, therefore, are not readily portable or usable while playing golf. Yet other known devices require the assistance of another person to assemble the device and to configure the device about a golfer's body for use by the golfer and are not practical for a golfer to take to a golf course for use by himself or herself either to play golf or to train for golf.

While there are currently training devices for golf that address issues related to posture, there are some aspects of posture and body alignment, coupled with ease of use, that are not apparent or possible with various known training devices. The golf posture and swing training harness of the present invention allows for convenience in set up, usage, and portability. It allows a golfer to use the harness of the present invention while training or playing in any golfing atmosphere (for example, on a driving range, on a golf course, in a park, or in a yard). The harness of the present invention is lightweight and may be easily donned by a user by himself or herself and does not require an additional person for assistance with set up, wearing, usage or porting of the harness. The harness of the present invention allows for a single device to be set up, worn, used and transported by a golfer and which harness or device readily adapts to a golfer's individual body type and size.

Additionally, the harness of the present invention enables a user to achieve proper posture in golf not only to execute an accurate swing, but also to prevent injury to the user, as well as serves as an aid for the user to improve his or her swing. Furthermore, the harness of the present invention provides the user with consistent motor feedback to ensure that through all stages of a golf swing the user maintains an appropriate posture. Also, the harness of the present invention serves as an effective training device for golf to enable the user to learn a perfect form for a golf swing, either from an initial introduction to the game of golf; to change a poor, learned habit; or to rehabilitate from an injury.

BRIEF SUMMARY OF THE INVENTION

A golf posture and swing training harness of the present invention comprises a body of a harness; a channel, wherein the channel extends a length of the body and along a centered, y-axis, middle section of the body, further wherein the channel has a channel top opening and a channel bottom opening; two shoulder straps attached to the body; at least a waist strap attached to the body; and a shaft, wherein the shaft is removably inserted within and extends beyond a channel top opening and a channel bottom opening of the channel.

Additionally, each shoulder strap may have a shoulder strap fastener and the waist strap may have a waist strap fastener. Preferably, the shaft is a non-flexible, rigid shaft and has a grip at a proximal end of the shaft.

Alternatively, the harness may further comprise at least a scapula bar slot on a back side of the body of the harness and a scapula bar; wherein the scapula bar is removably inserted within a scapula bar slot.

Further alternatively, the harness may further comprise at least a waist strap loop on a front side of the body of the harness; wherein the waist strap is removably inserted within a waist strap loop.

Further alternatively, the harness may further comprise two sternum straps; wherein a sternum strap is attached to a shoulder strap, another sternum strap is attached to another shoulder strap, and the sternum straps have a sternum strap fastener.

BRIEF DESCRIPTION OF THE SEVERAL VIEWS OF THE DRAWING(S)

LIST OF REFERENCE NUMERALS

Figure 1:
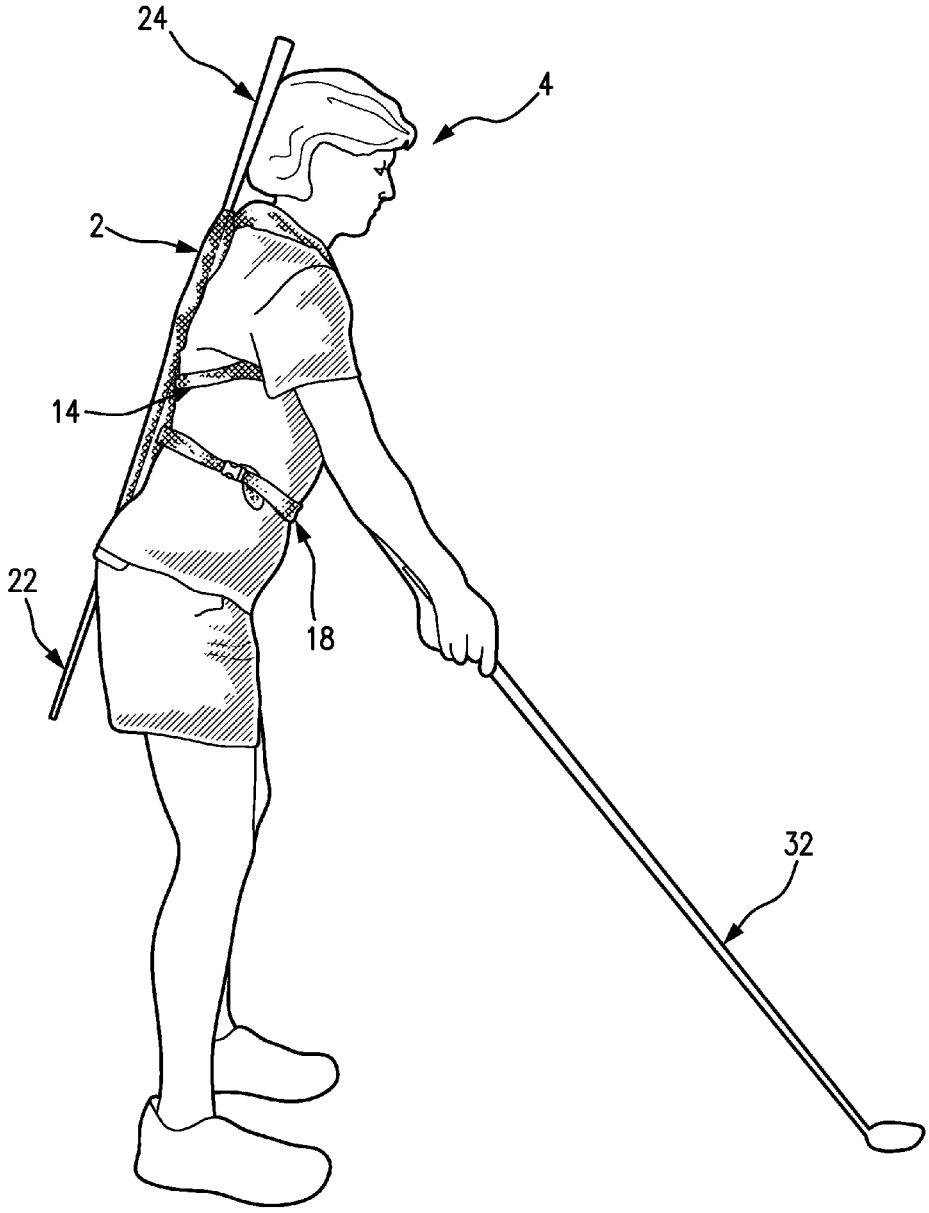
FIG. 1 is a right side view of a user wearing a harness of the present invention.
Figure 2:
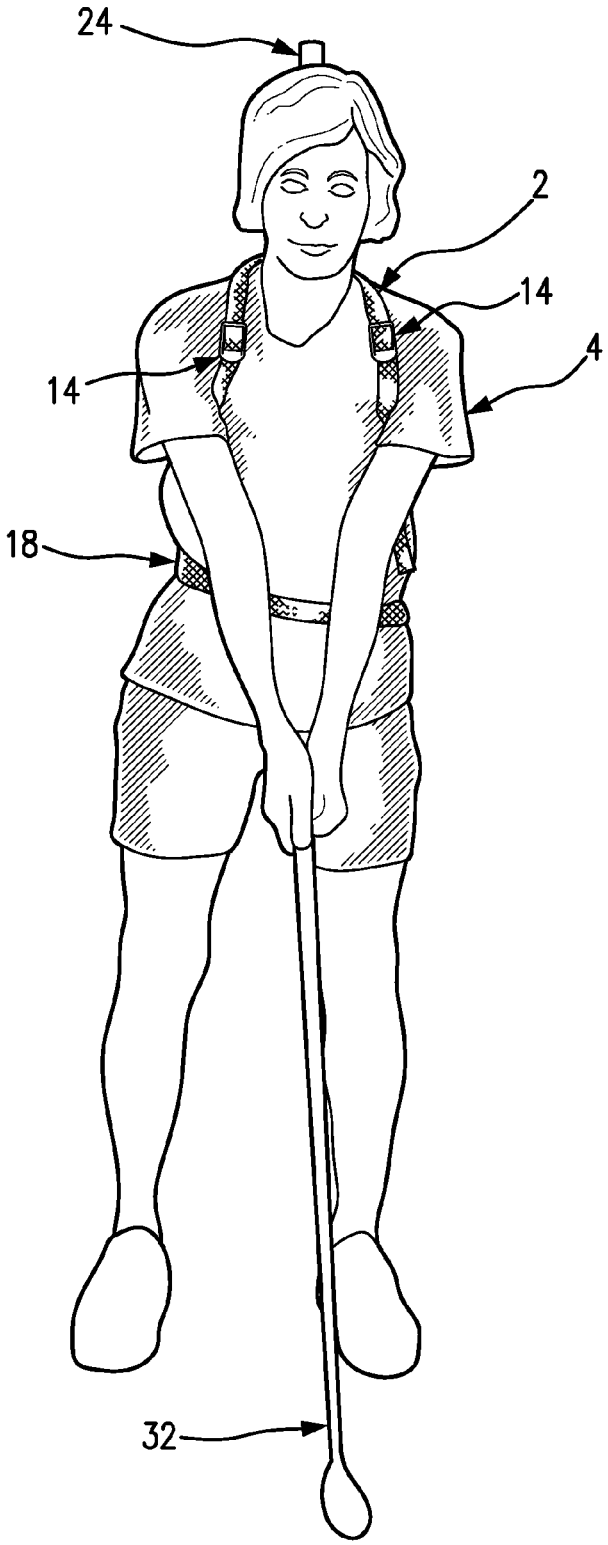
FIG. 2 is a front view of a user wearing the harness of the present invention.

2 harness
4 user
6 front side of harness
8 back side of harness
10 top of harness
12 bottom of harness
14 shoulder strap
16 shoulder strap fastener
18 waist strap
20 waist strap fastener
22 shaft
24 grip
26 channel
28 channel top opening
30 channel bottom opening
32 golf club
34 sternum strap
36 sternum strap fastener
38 scapula bar
40 scapula bar slot
42 waist strap loop
44 body of harness

DETAILED DESCRIPTION OF THE INVENTION

A golf posture and swing training harness of the present invention is readily portable and employable by a golfer or a user without the need for assembly of the harness, assistance of another to don, use or transport the harness, anchoring of the harness with the ground, or configuration of the harness about the user's body. The harness of the present invention is portable, lightweight and may be used by a user during either golf playing or golf training.

The harness of the present invention allows for constant feedback for a golfer to be able to gain and retain muscle memory even after the harness is not being used. The feedback provided by the harness is consistent and reliable. The harness provides for three points of contact with a user's body, namely, a back of a head, a scapular or upper back area, and a sacrum or lower back area.

While using the harness, once the user is in a proper position, the three points of contact also allow for the user to maintain balance and stability through all stages of the user's golf swing. Correct posture of the user through the golf swing is necessary, as the golf swing is dependent on the user's ability to rotate through the swing. In order to swing a golf club with the most efficiency and consistency, the user's body must be able to rotate in the region of the user's thoracic vertebrae, which rotation will allow the user's shoulders to turn properly throughout both a backswing and downswing. Thus, an ideal golf posture at set-up for a golf swing allows the user's body to rotate without compensation by other body parts. When the user's body is in proper golf spinal alignment, the user's shoulders are back and the user's chest is up, the result is a more consistent swing and allows for better contact of a golf club head with a golf ball, which in turn leads to more power and distance of the golf ball flight after striking the golf ball. If the user's spine is too flexed or rounded, then the user's body compensates by using other parts of the body with less efficiency and leads to reductions in consistency, distance, and power of the golf ball flight. This compensation can result in pains related to the golf swing (for example, lumbar spine injury or shoulder dislocation injury). This flexing or rounding of the user's spine is a common, yet incorrect, stance that golfers assume prior to swinging the golf club. The problem with this flexed spine postural position is that it does not allow the golfer to rotate his or her body in the thoracic spine area and results in a limited turning of the golfer's shoulders during a golf swing.

The harness of the present invention allows the user to learn to swing properly with a neutral spinal alignment. When a golfer starts with a perfect golfer posture, the golfer is taking the first step toward having a consistent golf game that allows the golfer's body to rotate efficiently and consistently for the best swing possible.

Figure 4:
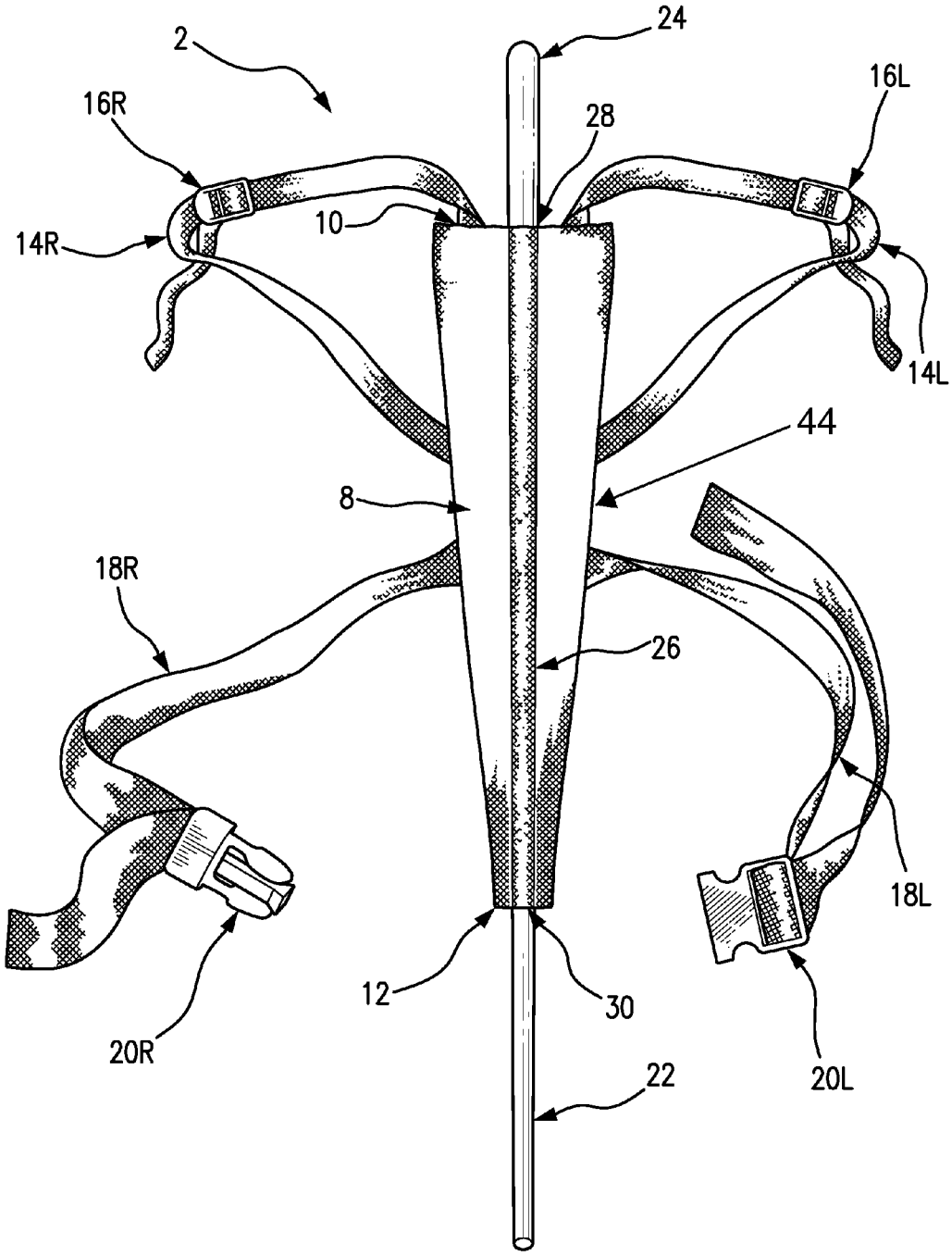
FIG. 4 is a plan view of an inside back of the harness of the present invention.
Figure 5:
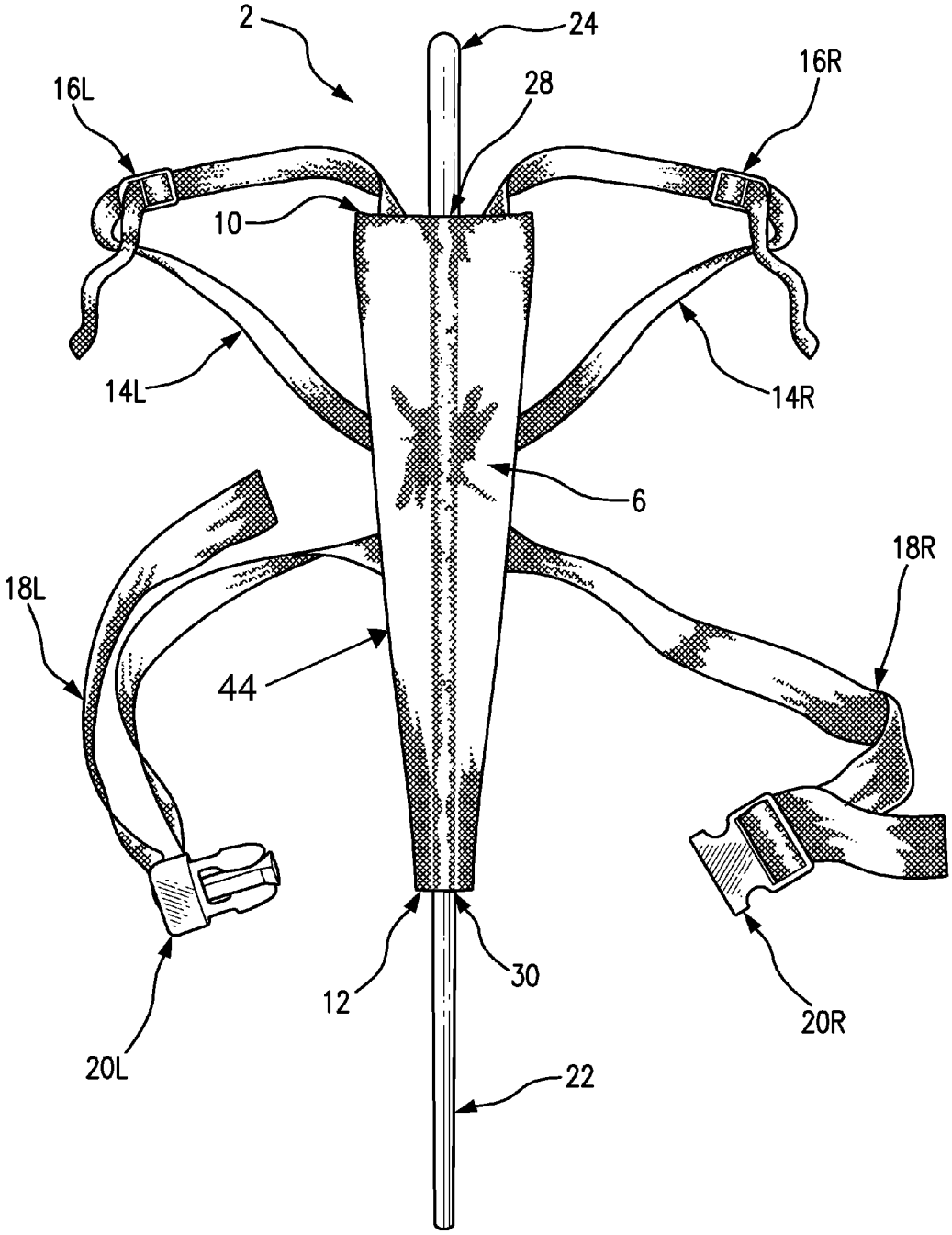
FIG. 5 is a plan view of an outside front of the harness of the present invention.

With reference to FIG. 4 and FIG. 5, in an embodiment of the present invention, a harness 2 comprises a body 44, two shoulder straps 16, at least a waist strap 18 and a shaft 22. The body 44 of the harness 2 preferably is trapezoidal in shape, but also may be rectangular or triangular in shape. The body 44 may be assembled from any suitable fabric or material that preferably is durable, lightweight and flexible to adapt to fit about contours of and move with a user's body. Examples of suitable fabrics for the body 44 are nylon, canvas and neoprene. The shoulder straps 16 and waist strap 18 may be of any suitable material that enables a user to wear the harness 2 on his or her body. Suitable materials are nylon, canvas, neoprene and elastic.

Figure 3:
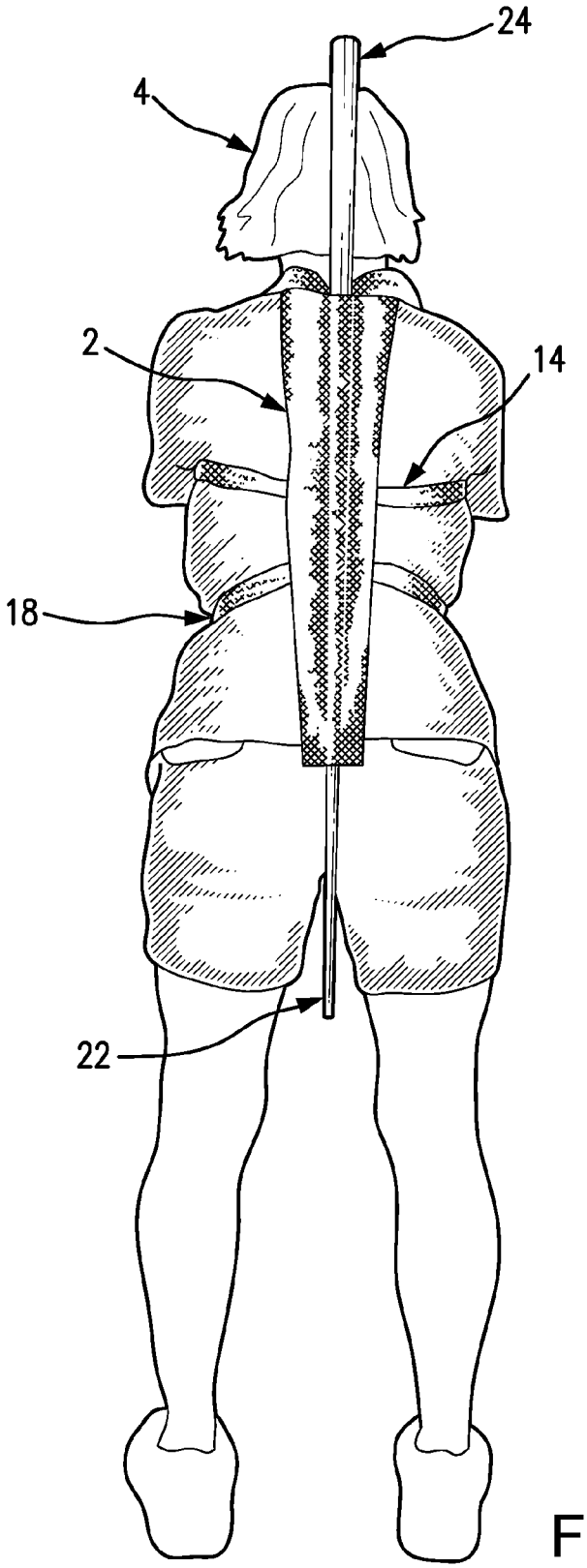
FIG. 3 is back view of a user wearing the harness of the present invention.
Figure 9:
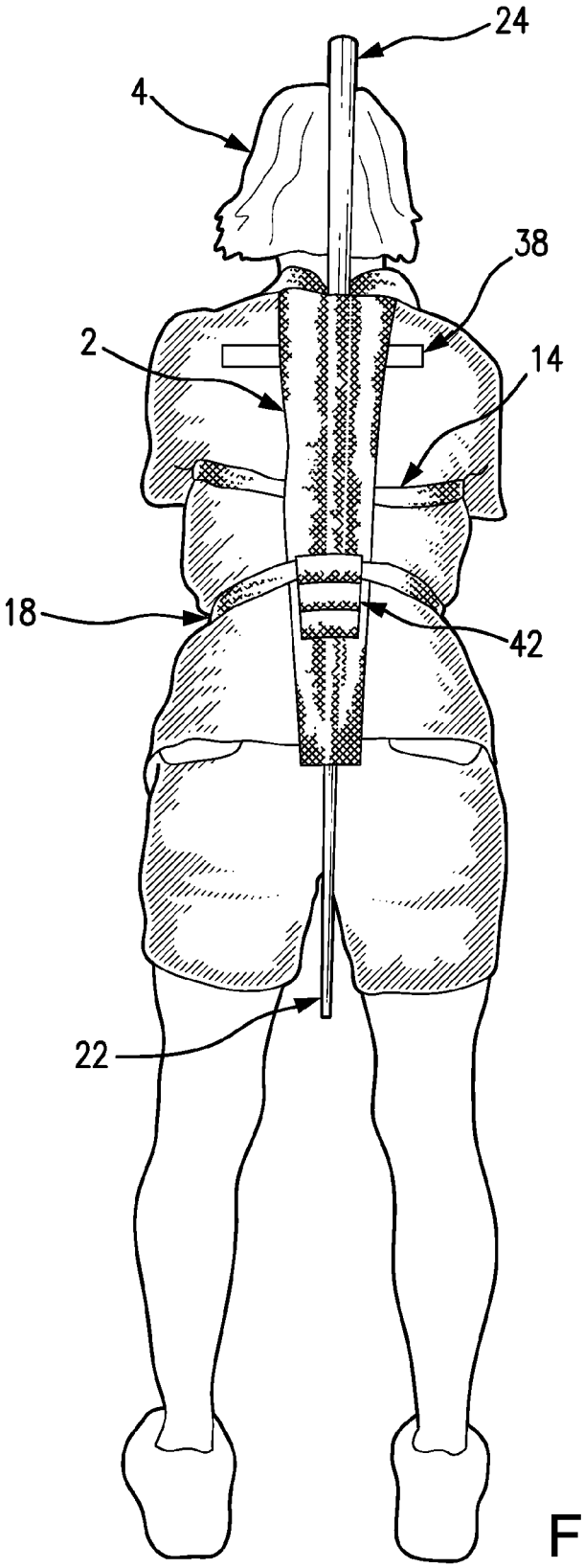
FIG. 9 is a back view of a user wearing an alternative embodiment of the harness of the present invention.

The body 44 of the harness 2 has preferred dimensions of from about 22.0" to about 25.0" in length, from about 5.0" to about 7.0" in width at a top of the harness 10 and from about 0.5" to about 7.0" in width at a bottom of the harness 12. The body 44 of the harness 2 preferably comprises at least two parts, a front side of harness 6 and a back side of harness 8, wherein the harness front 6 and harness back 8 are attached to each other by any suitable means, such as sewing, gluing or heat fusing, to form the body 44. As shown in FIGS. 3 and 9, when the harness 2 is worn by a user 4, a harness back 8 faces toward and preferably contacts a back of the user 4 and the harness front 10 faces away from and preferably does not contact the back of the user 4.

With reference to FIGS. 4 through 7, a channel 26 extends the length of the body 44 and along a centered, y-axis, middle section of the body 44. The channel 26 has a channel top opening 28 and a channel bottom opening 30. The channel 26 may receive or have removably inserted into the channel 26 a non-flexible, rigid and fixed length shaft 22, preferably a golf club shaft and which may be made of carbon graphite or other suitable material; wherein a distal, non-grip end of the shaft 22 can be inserted into the channel top opening 28, passed through the length of the channel 26 and exited out the channel bottom opening 30. The shaft 22 may be from about 35.0" to about 43.0" in length.

Alternatively, the shaft 22 may not be a golf club shaft and may be any other suitable shaft 22 or rod of comparable weight, dimensions and non-flexible and rigidity characteristics. Also alternatively, the shaft 22 may not be a fixed length, but rather may be a multi-part assemblable, collapsible, foldable or telescoping shaft 22; provided, however, that when such alternative shaft 22 is fully extended, the shaft 22 is of comparable weight and dimensions and non-flexible and rigidity characteristics as a fixed length shaft 22.

A stop means or a grip 24 on a proximal end of the shaft 22 prevents the shaft 22 from passing all the way through and out the channel 26. The grip 24 also allows for a 1.0" to 3.0" natural space to occur between the grip 24 and a user's 4 cervical vertebrae. The stop means or grip 24 may be either a golf grip or other suitable means, such as a closed-cell expanded polystyrene foam (such as Styrofoam® brand) donut-shape stopper engirding the shaft 22, and which stop means or grip 24 prevents the shaft 22 from passing all the way through and out of the channel 26.

Preferably, the shaft 22, including the grip 24, extends beyond the top channel opening 28 from about 9.0" to about 11.0". Further preferably, the shaft 22 extends beyond the bottom channel opening 30 from about 2.0" to about 10.0". An extension of an upper portion of the shaft 22 beyond the top channel opening 28 allows the upper portion of the shaft 22 to touch the back of the user's 4 head; and an extension of a lower portion of the shaft 22 beyond the bottom channel opening 30 allows the lower portion of the shaft 22 to touch the user's 4 lower back or sacrum area. Contact of the shaft 22 with the user's 4 body is imperative and, therefore, the shaft 22 must extend beyond and cannot be flush with the either the top channel opening 28 or the bottom channel opening 30 of the harness 2. The contact of the grip 24 or the upper portion of the shaft 22 with the back of the user's 4 head is significant and an important reminder to the user 4 to not lower the user's head to look at a golf ball while executing a golf swing. To successfully use the harness 2 of the present invention, the user 4 must maintain the alignment of the three points of contact of the harness 2 and shaft 22 with the user's 4 back of the head, scapular area or thoracic vertebrae, and the lower back or sacrum.

The channel 26 preferably is created upon the harness back 8 and is encased within the body 44, runs the length of the body 44 from a top of harness 10 to a bottom of harness 12 and is of a sufficient width to receive a shaft 22, or a channel 26 width from about 1.0." to about 2.0". For example, a means of creating the channel 26 is to attach a gross grain ribbon or other suitable material to the harness back 8 in a manner that creates and leaves a channel 26 that extends the length of the body 44 and along a centered, y-axis, middle section of the body 44. To create the body 44, the harness back 8 is then attached to the harness front 6 such that the channel 26 preferably is disposed between the harness back 8 and the harness front 6 of the body 44.

As shown in FIGS. 1, 3 and 9, when a user 4 wears the harness 2 of the present invention, the channel 26 and the shaft 22 within the channel 26 align with and contact a body of the user 4. The shaft 22 contacts the user 4 at various areas along the spine's length, from approximately a distal end of a sacrum vertebrae to approximately a first thoracic vertebrae (also known as a T1 vertebrae), and along a back of a head of the user 4. Preferably, the shaft 22 within the harness 2 contacts three key areas of the user's 4 body, namely, a back of a head, a scapular area or thoracic vertebra area, and a lower back area or a sacrum, of the user 4.

As shown in FIGS. 1 through 3, 8 and 9, having the shaft 22 align with and contact the spine and head of the user 4 assists the user in properly addressing a golf club 32 and in keeping his or her spine straight and in a proper alignment to execute a proper golf swing. As a result, the user 4 rotates the user's 4 shoulders around his or her thoracic vertebrae or spinal axis as a unit while executing the golf swing, rather than the user 4 compensating by using only the user's 4 arms, or forcing unnatural mobility at lumbar vertebrae of the user 4. If a user 4 has limited thoracic rotation, then the user 4 creates problems in the user's shoulder joints as a result of using only the user's arms, or by creating torsion in a lumbar section of the user's 4 spine that may result in injury to the user 4 and produce an erroneous swing.

With reference to FIGS. 1 through 9, the harness 2 has shoulder straps 14 (a right shoulder strap 14R and a left shoulder strap 14L) which preferably are adjustable. The shoulder straps 14 are used to wear the harness 2 on the user's 4 body and the shoulder straps 14 may be adjusted to best fit the harness 2 on the user 4 by means of shoulder strap fasteners 16 (a right shoulder strap fastener 16R and a left shoulder strap fastener 16L). The shoulder strap fasteners 16 may be any suitable fastener capable of allowing adjustment of the shoulder straps 14, such as a ladder lock fastener, buckle, side release buckle, or cam buckle.

With reference to FIGS. 4 through 7, an end of an upper portion of a shoulder strap 14 attaches at and extends from a top of harness 10 and another opposite end of an upper portion of the shoulder strap 14 engages with the shoulder strap fastener 16. Similarly, an end of a lower portion of a shoulder strap 14 attaches at and extends from an upper side section of the body 44 of the harness 2 and another opposite end of a lower portion of the shoulder strap 14 engages with the shoulder strap fastener 16. When worn by a user 4, the shoulder strap fasteners 16 are used to adjust the shoulder straps 14 so that the harness 2 best fits the user 4.

With reference to FIGS. 1 through 9, the harness 2 has a waist strap 18 (which may comprise a right waist strap 18R and a left waist strap 18L) which preferably is adjustable. The waist strap 18 may be adjusted to best fit the user 4 by means of a waist strap fastener 20 (which may comprise a right waist strap fastener 20R and a left waist strap fastener 20L). The waist strap fastener 20 may be any suitable fastener capable of allowing adjustment of the waist strap 18, such as a ladder lock fastener, buckle, side release buckle, or cam buckle.

With reference to FIGS. 4 and 5, in an embodiment of the present invention an end of a right waist strap 18R fixedly attaches at and extends from a right-side mid-section of the body 44 of the harness 2 and another opposite end of the right waist strap 18R engages with the waist strap fastener 20R. Similarly, an end of a left waist strap 18L fixedly attaches at and extends from a left-side mid-section of the body 44 of the harness 2 and another opposite end of the left waist strap 18L engages with the waist strap fastener 20L. When worn by a user 4, the waist strap fastener 20 is used to adjust the waist strap 18 so that the harness 2 best fits the user 4.

Figure 7:
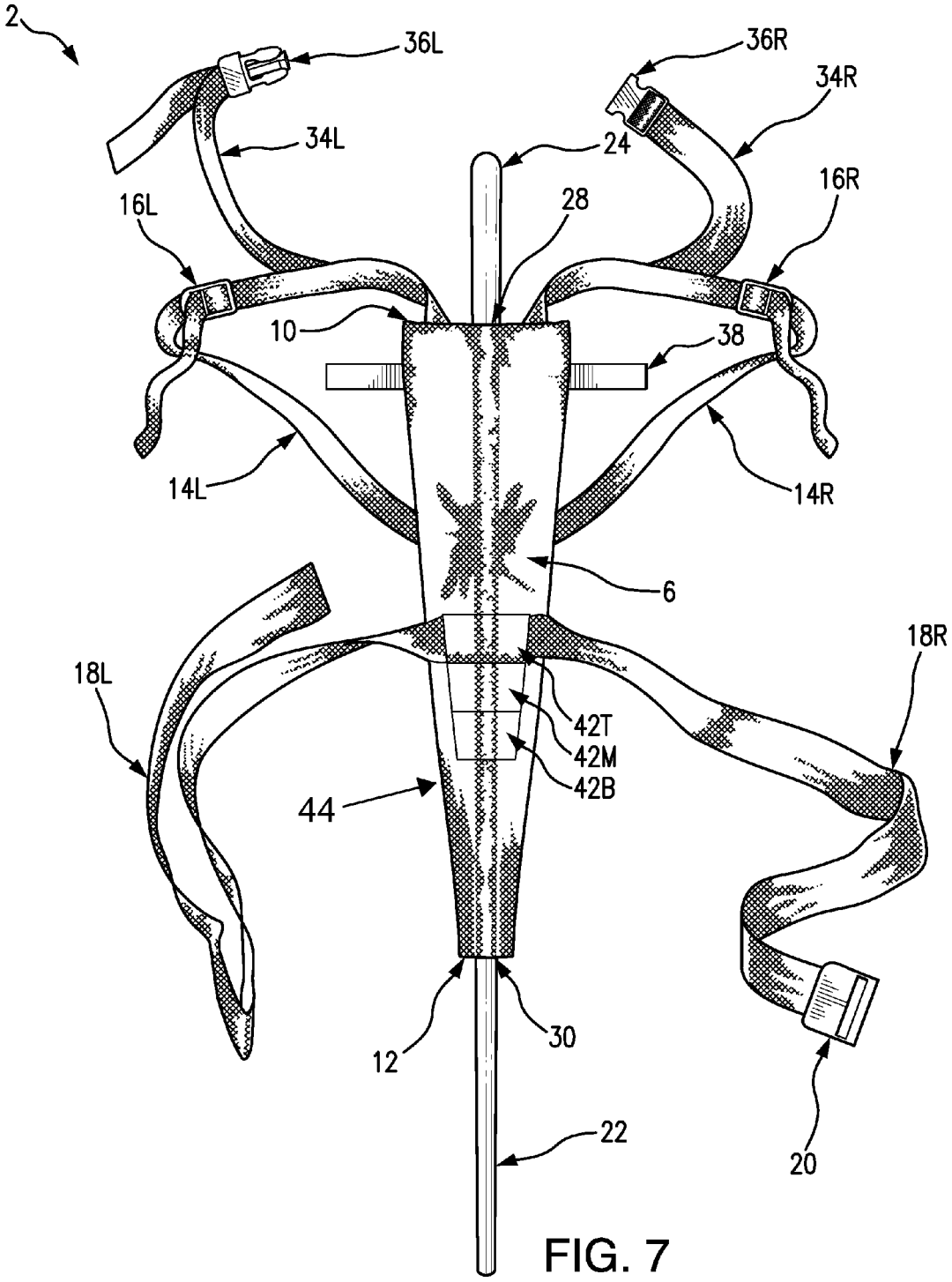
FIG. 7 is a plan view of an outside front of an alternative embodiment of the harness of the present invention.
Figure 8:
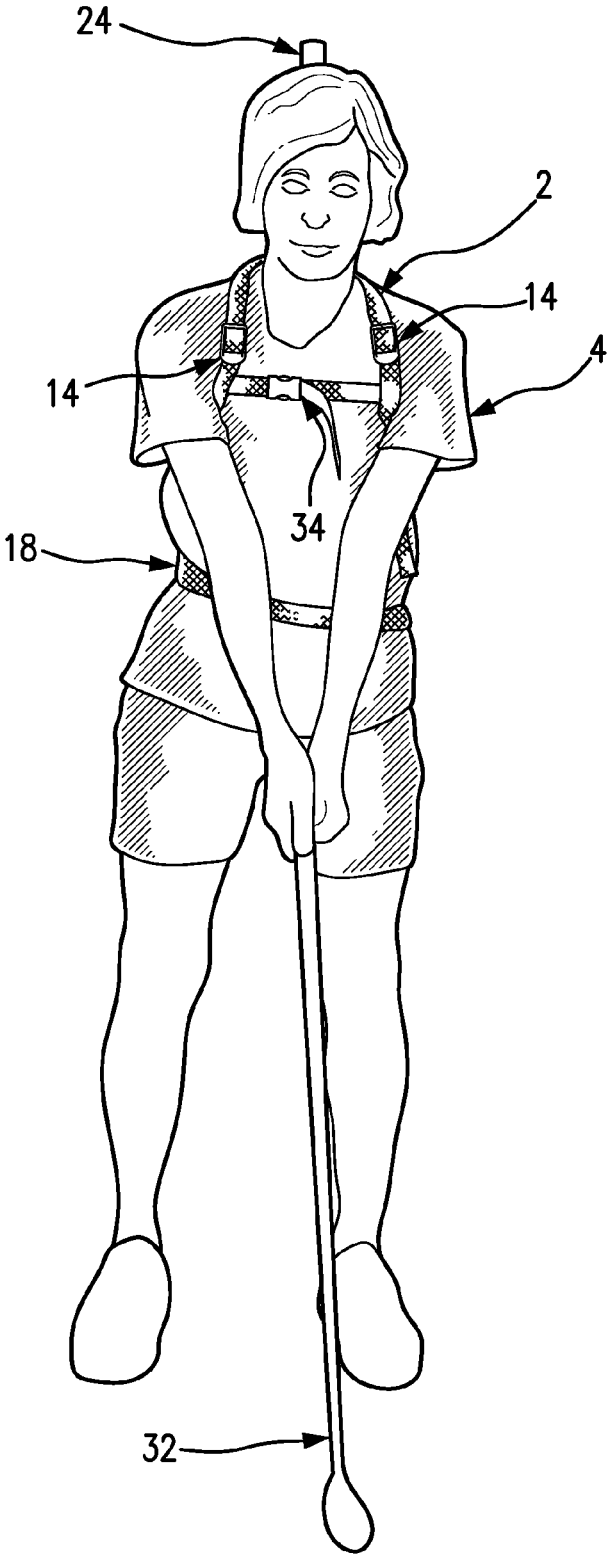
FIG. 8 is a front view of a user wearing an alternative embodiment of the harness of the present invention.

With reference to FIGS. 7 and 9, shown is an alternative embodiment of the harness 2 of the present invention. The alternative embodiment has at least an optional waist strap loop 42. As shown in FIG. 7, the waist strap loop 42 is placed upon a harness front 6. The waist strap loop 42 may have multiple waist strap loops, such as a top waist strap loop 42T, a middle waist strap loop 42M and a bottom waist strap loop 42B. A purpose of the waist strap loop 42 is to enable a user 4 further to best fit and align the harness 2 on his or her body. The waist strap 18 may be removably attached to the harness 2 by means of removably inserting or threading the waist strap 18 through whichever waist strap loop 42 best fits the harness 2 upon the user's 4 body and creates feedback pressure at the user's 4 lower back or sacrum point of contact.

With reference to FIGS. 6 through 9, an alternative embodiment of the harness 2 of the present invention is shown. The alternative embodiment has an optional sternum strap 34 (a right sternum strap 34R and a left sternum strap 34L). The sternum strap 34 may be of any suitable material that enables a user to wear the harness 2 on his or her body. Suitable materials are nylon, canvas, neoprene and elastic.

The sternum straps 34 may be adjusted to best fit the harness 2 on the user 4 by means of sternum strap fasteners 36 (a right sternum strap fastener 36R and a left sternum strap fastener 36L). The sternum strap fasteners 36 may be any suitable fastener capable of allowing adjustment of the sternum straps 34, such as a ladder lock fastener, buckle, side release buckle or cam buckle.

An end of a right sternum strap 34R attaches to and extends from a mid-section of the right shoulder strap 16R and another opposite end of the right sternum strap 34 engages with a sternum strap fastener 36R. Similarly, an end of a left sternum strap 34R attaches at and extends from a mid-section of the left shoulder strap 16L and another opposite end of the left sternum strap 34L engages with a sternum strap fastener 36L. When worn by a user 4, the sternum strap fasteners 36 are used to adjust the sternum straps 34 so that the harness 2 best fits the user 4 and provides more comfort in the user's 4 shoulder area during all stages of the golf swing.

Figure 6:
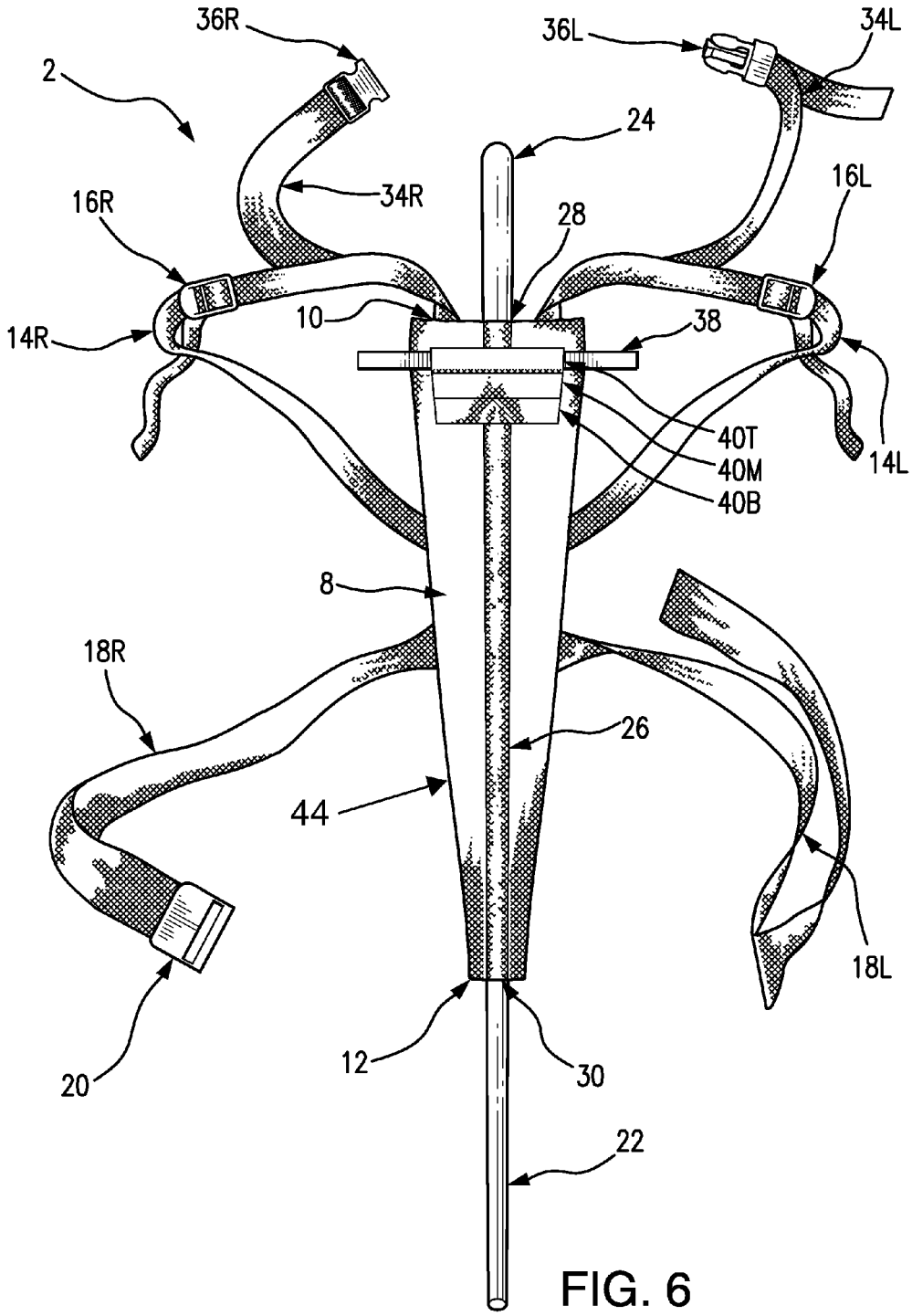
FIG. 6 is a plan view of an inside back of an alternative embodiment of a harness of the present invention.

With reference to FIGS. 6, 7 and 9, shown is another alternative embodiment of the harness 2 of the present invention. The alternative embodiment has an optional scapula bar 38 that may be inserted within at least a scapula bar slot 40. The scapula bar 38 aligns with and contacts scapulae of a user 4. The scapula bar 38 may be made of any suitable rigid material, such as plastic, metal or wood. Preferably, the scapula bar 38 is rectangular in shape and from about 1.0" to about 2.0" in width and from about 5.0" to about 12.0" in length. The scapula bar 38, when inserted within a scapula bar slot 40, is aligned along the length of the scapula bar 38 in perpendicular relation to the spine of the user 4.

A purpose of the scapula bar 38 is to enable a user 4 further to best align the harness 2 on his or her body and to assist the user 4 in achieving proper golf posture by keeping his or her shoulders back and in contact with the scapula bar 38. As previously mentioned and shown in FIGS. 1 through 3, 8 and 9, having the scapula bar 38 align with and contact the scapulae of the user 4, as well as having the shaft 22 align with and contact the spine and back of the head of the user 4, assists the user in properly addressing a golf club 32 and in keeping his or her spine straight and in a proper alignment for executing a proper golf swing. As a result, the user 4 rotates the user's 4 shoulders around his or her thoracic vertebrae or a spinal axis as a unit while executing a golf swing, rather than the user 4 compensating by using only the user's 4 arms, or forcing unnatural mobility at lumbar vertebrae. If a user 4 has limited thoracic rotation, then the user 4 creates problems in the user's shoulder joints as a result of using only the user's arms, or by creating torsion in a lumbar section of the user's 4 spine that may result in injury to the user 4 and produce an erroneous swing. The scapula bar 38 reminds and allows the user 4 to keep the user's 4 shoulders back, allowing rotation of the user's torso to occur and to maintain a neutral position of the user's 4 spine while executing a golf swing.

As shown in FIG. 6, at least a scapula bar slot 40 is placed upon a harness back 8. The scapula bar slot 40 may have multiple scapula bar slots, such as a top scapula bar slot 40T, a middle scapula bar slot 40M and a bottom scapula bar slot 40B. For optimal fit and alignment of the harness 2 on the body of a user 4, the scapula bar 38 may inserted within any scapula bar slot 40 that best coincides with scapulae of the user 4.

Although the present invention has been described with reference to specific embodiments, it is understood that modifications and variations of the present invention are possible without departing from the scope of the invention, which is defined by the claims set forth below. Unless defined otherwise, all technical and scientific terms used herein have the same meaning as commonly understood by one of ordinary skill in the art to which this invention belongs. Although any methods and materials similar or equivalent to those described herein also can be used in the practice or testing of the present invention, the preferred methods and materials are described.

The invention claimed is:

1. A golf posture and swing training harness comprising:

a. A body of a harness;

b. A channel; wherein the channel extends a length of the body and along a centered, y-axis, middle section of the body; further wherein the channel has a channel top opening and a channel bottom opening;

c. Two shoulder straps attached to the body; wherein each shoulder strap has a shoulder strap fastener;

d. At least a waist strap attached to the body; wherein the waist strap has a waist strap fastener;

e. A shaft; wherein the shaft is removably inserted within and extends beyond the channel top opening and the channel bottom opening of the channel; further wherein the shaft is a non-flexible, rigid shaft and has a grip at a proximal end of the shaft; and f. At least a scapula bar slot on a back side of the body of the harness.

2. A harness as claimed in claim 1 further comprising a scapula bar; wherein the scapula bar is removably inserted within a scapula bar slot.

3. A harness as claimed in claim 1 further comprising two sternum straps; wherein a sternum strap is attached to a shoulder strap and another sternum strap is attached to another shoulder strap.

4. A harness as claimed in claim 3 further wherein the sternum straps have a sternum strap fastener.

5. A golf posture and swing training harness comprising:

a. A body of a harness;

b. A channel; wherein the channel extends a length of the body and along a centered, y-axis, middle section of the body; further wherein the channel has a channel top opening and a channel bottom opening;

c. Two shoulder straps attached to the body; wherein each shoulder strap has a shoulder strap fastener;

d. At least a waist strap removably attached to the body; wherein the waist strap has a waist strap fastener;

e. At least a waist strap loop on a front side of the body of the harness; wherein the waist strap is removably inserted within a waist strap loop; and f. A shaft; wherein the shaft is removably inserted within and extends beyond the channel top opening and the channel bottom opening of the channel.

6. A harness as claimed in claim 5 further comprising at least a scapula bar slot on a back side of the body of the harness.

7. A harness as claimed in claim 6 further comprising a scapula bar; wherein the scapula bar is removably inserted within a scapula bar slot.

8. A harness as claimed in claim 5 further wherein the shaft is a non-flexible, rigid shaft.

9. A harness as claimed in claim 5 further wherein the shaft has a grip at a proximal end of the shaft.

10. A harness as claimed in claim 5 further comprising two sternum straps; wherein a sternum strap is attached to a shoulder strap and another sternum strap is attached to another shoulder strap.

11. A harness as claimed in claim 10 further wherein the sternum straps have a sternum strap fastener.

12. A golf posture and swing training harness comprising:

a. A body of a harness;

b. A channel; wherein the channel extends a length of the body and along a centered, y-axis, middle section of the body; further wherein the channel has a channel top opening and a channel bottom opening;

c. Two shoulder straps attached to the body; wherein each shoulder strap has a shoulder strap fastener;

d. At least a waist strap removably attached to the body; wherein the waist strap has a waist strap fastener;

e. At least a waist strap loop on a front side of the body of the harness; wherein the waist strap is removably inserted within a waist strap loop;

f. At least a scapula bar slot on a back side of the body of the harness;

g. A scapula bar; wherein the scapula bar is removably inserted within a scapula bar slot; and h. A non-flexible, rigid shaft; wherein the shaft is removably inserted within and extends beyond a channel top opening and a channel bottom opening of the channel; further wherein the shaft has a grip at a proximal end of the shaft.

13. A harness as claimed in claim 12 further comprising two sternum straps; wherein a sternum strap is attached to a shoulder strap and another sternum strap is attached to another shoulder strap; further wherein the sternum straps have a sternum strap fastener.

14. A golf posture and swing training harness comprising:

a. A body of a harness;

b. A channel; wherein the channel extends a length of the body and along a centered, y-axis, middle section of the body; further wherein the channel has a channel top opening and a channel bottom opening;

c. Two shoulder straps attached to the body; wherein each shoulder strap has a shoulder strap fastener;

d. At least a waist strap removably attached to the body; wherein the waist strap has a waist strap fastener;

e. At least a waist strap loop on a front side of the body of the harness; wherein the waist strap is removably inserted within a waist strap loop;

f. At least a scapula bar slot on a back side of the body of the harness;

g. A scapula bar; wherein the scapula bar is removably inserted within a scapula bar slot;

h. Two sternum straps; wherein a sternum strap is attached to a shoulder strap and another sternum strap is attached to another shoulder strap; further wherein the sternum straps have a sternum strap fastener; and i. A non-flexible, rigid shaft; wherein the shaft is removably inserted within and extends beyond a channel top opening and a channel bottom opening of the channel; further wherein the shaft has a grip at a proximal end of the shaft.

* * * * *